US005491851A

United States Patent [19]

Alonso

[11] Patent Number: 5,491,851

[45] Date of Patent: Feb. 20, 1996

[54] CHILD'S MULTIPURPOSE, MULTISECTIONAL MAT WITH CARRYING HANDLES

[76] Inventor: Frank Alonso, 350 E. 18th St., Yuma, Ariz. 85364

[21] Appl. No.: 189,691

[22] Filed: Feb. 1, 1994

[51] Int. Cl.[6] ..... A47G 9/06; A47C 27/14

[52] U.S. Cl. ..... 5/465; 5/420

[58] Field of Search ..... 5/465, 420, 470, 5/466, 655; 190/1, 2

[56] References Cited

U.S. PATENT DOCUMENTS

| | | | |
|---|---|---|---|
| 836,326 | 11/1906 | Kinyon | 5/465 |
| 846,445 | 3/1907 | Baker | 5/465 |
| 1,349,258 | 8/1920 | Blocksom | 5/490 |
| 3,323,151 | 6/1967 | Lerman | 5/420 |
| 3,336,610 | 8/1967 | Giddings | 5/420 |
| 3,879,775 | 4/1975 | Iwata . | |
| 4,188,988 | 2/1980 | Agyagos | 150/1.7 |
| 4,190,918 | 3/1980 | Harvell | 5/420 |
| 4,592,091 | 5/1986 | Italici | 383/15 |
| 4,843,662 | 7/1989 | Handelman | 5/420 |
| 5,010,610 | 4/1991 | Ackley | 5/481 |
| 5,035,013 | 7/1991 | Bloom | 5/420 |
| 5,048,975 | 9/1991 | Holbrook | 383/4 |
| 5,099,530 | 3/1992 | Scott | 5/420 |
| 5,203,041 | 4/1993 | Alonso | 5/420 |

FOREIGN PATENT DOCUMENTS

| | | | |
|---|---|---|---|
| 562409 | 11/1923 | France | 5/465 |
| 148769 | 2/1904 | Germany | 5/490 |
| 1049458 | 11/1966 | United Kingdom | 5/465 |
| 1264919 | 2/1972 | United Kingdom . | |

*Primary Examiner*—Alexander Grosz

[57] ABSTRACT

A multipurpose, multisectional mat for a child's use in resting, sitting, lying, reading and like activities comprising multiple articulated sections interconnected to form a mat which when flat provides a continuous resting surface formed by edge-to-edge abutting sections to accommodate a recumbent child and which when folded with the sections abutted face-to-face will provide a child's seat or table, each section comprising a generally rectangular soft cushion pad of substantial thickness and resilience and a fabric cover covering the pad, the fabric being locally continued beyond the pads alternately high and low and joined there as a hinge between adjacent pads for edge-to-edge or face-to-face orientation.

5 Claims, 3 Drawing Sheets

CHILD' S MULTIPURPOSE, MULTISECTIONAL MAT WITH CARRYING HANDLES

FIELD OF THE INVENTION

This invention has to do with child's multipurpose mats, mats that are useful to lie upon, sit upon, rest against and to otherwise support the child's body during activities ranging from television watching, story listening, and rest times, as well as useful as a low table or play surface. More particularly, the invention relates to a multipurpose, multisectional mat which is simple enough in form and function for a small child to use, and easily portable with appropriately placed and sized panels and handles for children to use by themselves. The invention mat sections arrange themselves in edge-to-edge abutting relation for continuous body support in rest mat usage, and in face-to-face abutting relation for compactness and stability of portaging and table use respectively.

BACKGROUND ART

In my earlier patent U.S. Pat. No. 5,203,041, I disclosed a child's rest mat comprising a foam pad capable of twice folding on itself and having a removable cover. In U.S. Pat. No. 4,843,662 to Handelman there is disclosed a stadium cushion having two separably joined seat cushions and a carrying case for the cushions. In Brit. patent 1,264,919 to Hudson a carryable seat cushion capable of being spread out for two or four persons is disclosed. In U.S. Pat. No. 5,048,975 to Holbrook a tote bag convertible to blanket, poncho or pad is disclosed. In U.S. Pat. No. 5,010,610 to Ackley a chair pad useful as a mat and portable by rolling up is disclosed. In U.S. Pat. No. 4,188,988 to Agyagos a tote bag convertible to a dressing tent or a beach mat is disclosed. In U.S. Pat. No. 4,592,091 to Italici a portable container handle is disclosed. In U.S. Pat. No. 5,099,530 to Scott an exercise pad and cover therefor is disclosed. In U.S. Pat. No. 3,879,775 to Iwata a three section cushion foldable into a pyramidal shape is disclosed. In U.S. Pat. No. 5,035,013 to Bloom an infant's play pen/mat disclosed foldable onto itself for carrying.

SUMMARY OF THE INVENTION

In the foregoing prior art of the various modes for interconnecting pads there is there is no recognition of the need for articulation of the adjacent pads by hinges adjacent the pad edge and alternately high and low such that the pads will lie flat upon one another in face-to-face abutment when stacked, and provide a flat surface for sitting of as a table top, and also be closely adjacent when end to end in edge-to-edge abutment for comfort in resting without uncomfortable gaps in cushioning.

It is an object of the present invention to provide a child's multipurpose mat made of multiple sections and arranged to be opened into a continuously extended mat, folded into a table or seat, or carried conveniently with integral handles. It is another object to provide a double hinged multipurpose child's mat wherein the hinge is defined by alternately high and low continued extents of the fabric cover joined together to permit free articulation of the mat section without straining the fabric cover and while permitting flat, face-to-face folding of the sections.

These and other objects of the invention are realized in a multipurpose, multisectional mat for a child's use in resting, sitting, lying, reading and like activities comprising first, middle and third sections interconnected to form a mat which when flat will accommodate a recumbent child and when folded will provide a child's seat or table, each section comprising a generally rectangular soft cushion pad of substantial thickness and resilience and a fabric cover covering the upper, lower and perimetrical portions of the pad, the first section lower portion-covering fabric having a continued extent, the middle section lower portion-covering fabric having a continued extent opposed and joined to the first section lower portion-covering fabric continued extent and forming a lower hinge therebetween, the third section upper portion-covering fabric having a continued extent, the middle section upper portion-covering fabric having a continued extent opposed and joined to the third section upper portion-covering fabric continued extent and forming an upper hinge therebetween, the upper and lower hinges being diametrically opposed across the middle section, whereby the sections are interconnected in alternately hinged relation to each other to be openable longitudinally in edge-to-edge abutting relation to form a flat mat and foldable flat upon themselves in face-to-face abutting relation to form a chair or table in a stacked horizontal orientation or for portage in a stacked vertical orientation, and handle means for carrying the mat in its vertical orientation.

In this and like embodiments, typically, the handle means comprise loops arranged in opposed relation across the middle section in the stacked condition of the sections; the handle means project from the first and third sections; the handle means are secured to the fabric covering adjacent the hinges; each section is like size to each other section; more specifically each of the sections have like width, length and thickness dimensions; the ratio of mat section length to width is between 0.5 and 1; the thickness of each mat section is between 2.5 and 5 inches such that the mat sections when stacked define a low table for a child; and each section fabric cover is locally double layered and partly unfastened along one edge margin opposite an edge of the section to permit insertion and withdrawal of the section between the layers.

In a preferred embodiment, the invention provides a multipurpose, multisectional mat for a child's use in resting, sitting, lying, reading and like activities comprising first, middle and third sections interconnected to form a mat which when flat will accommodate a recumbent child on abutted sections and when folded will provide a child's seat or table, each section comprising a generally rectangular soft cushion pad of substantial thickness and resilience and a fabric cover covering the upper, lower and perimetrical portions of the pad, the sections being articulated to one another by local portions of the fabric cover joined between the pads in hinge-forming relation for the sections to alternately lie in edge-to-edge abutting relation when the mat is elongated and in face-to-face abutting relation when the mat sections are stacked.

THE DRAWINGS

The invention will be further described in conjunction with the attached drawings in which.

DETAILED DESCRIPTION

Figure 8:
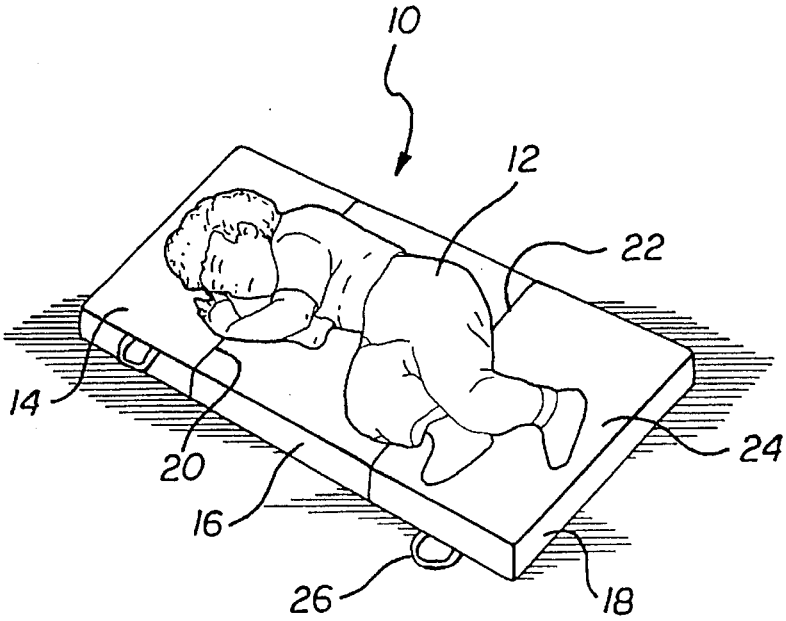
FIG. 8 is a pictorial view of the mat longitudinally extended with the abutted sections providing continuous support for the child user.
Figure 9:
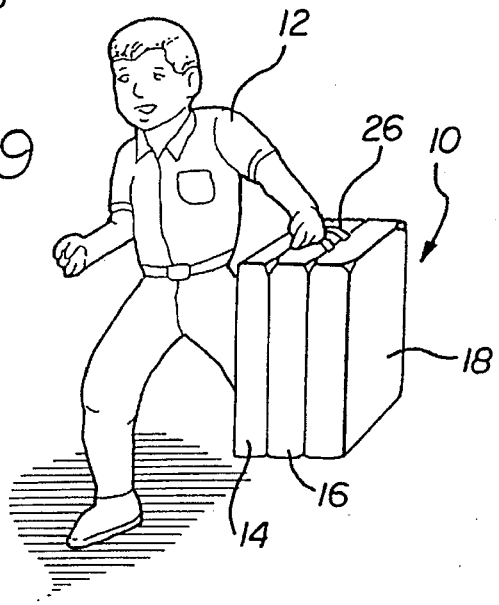
FIG. 9 is a pictorial view of the mat being ported by a child.
Figure 10:
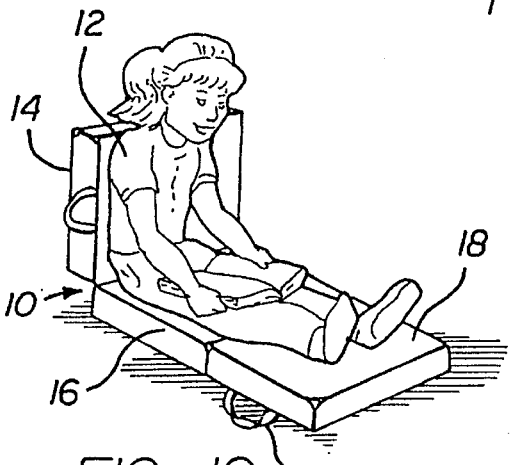
FIG. 10 is a pictorial view of the mat partly folded and partly extended for support of a child in sitting position; and, FIG. 11 is a pictorial view of the mat in horizontally stacked relation for use as a play table.
Figure 11:
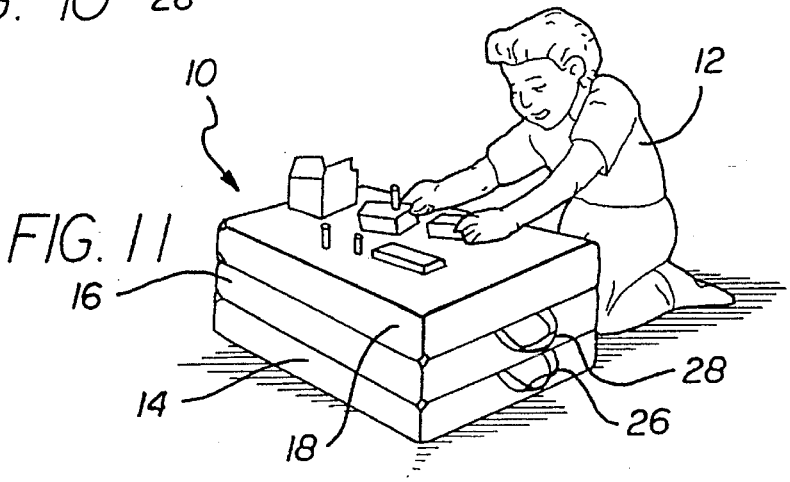

With reference now to the drawings in detail, the use versatility of invention mat 10 is shown in FIGS. 8–11. The mat 10 is shown in FIG. 8 arranged for resting a recumbent child 12, the mat being longitudinally disposed with its first, middle and third sections 14, 16, 18 respectively abutted edge-to-edge at 20, 22 respectively to provide a continuous resting surface 24 free of depressions, discontinuities and divides. In FIG. 9 the child 12 is shown carrying the mat 10, the mat sections 14, 16 and 18 having been folded into face-to-face engagement, the handles 26, 28 projecting from the folded sections being used to carry the mat in closed condition. In FIG. 10, the mat 10 is folded up at one end from its elongated position shown in FIG. 8, and the upraised section 14 (supported by a wall, chair or other support not shown) provides a padded backrest, while the middle and third sections 16, 18 provide a continuous support for hips and legs. In FIG. 11, the mat 10 is again folded as in FIG. 9, but the orientation of the sections 14, 16 and 18 is horizontal; the collective height of the sections being approximately 9 inches which is ideal for a child's seat or as a table or playing surface.

Figure 1:
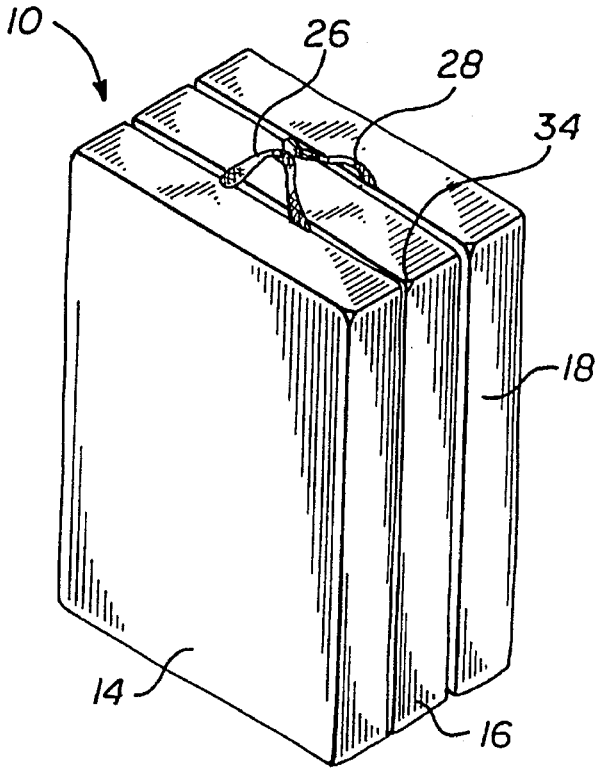
FIG. 1 is an axonometric view of the present mat folded face-to-face and vertically oriented for portage.
Figure 4:
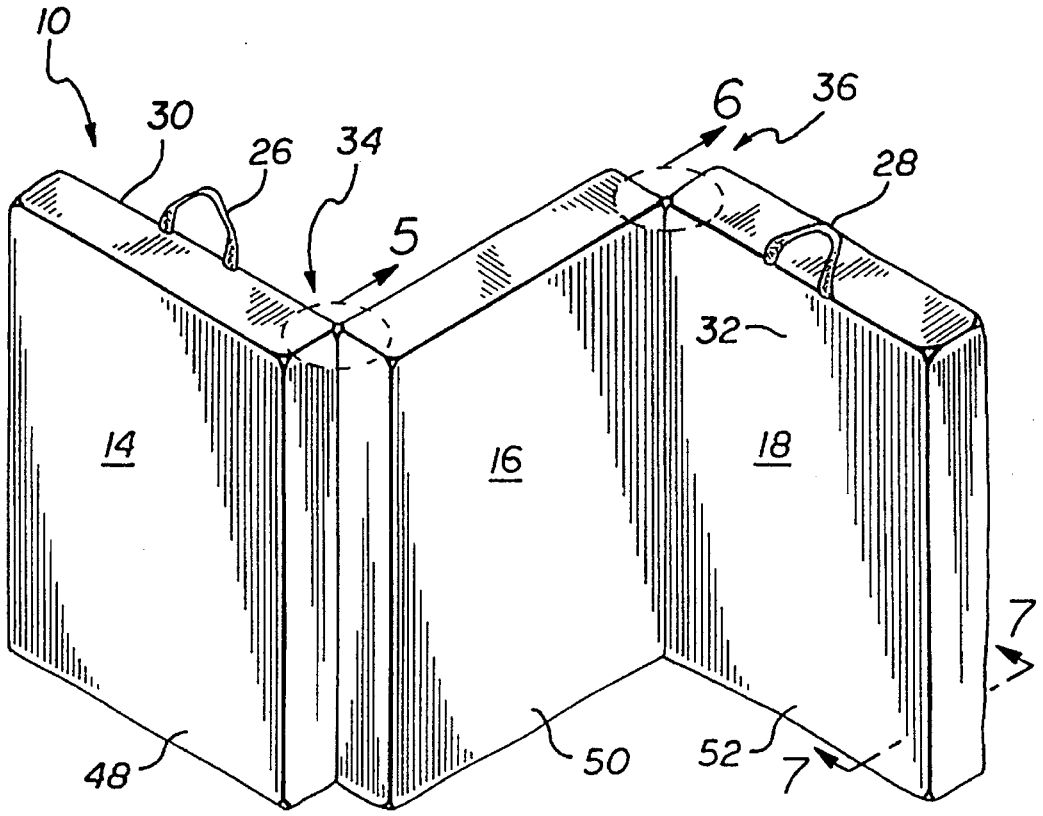
FIG. 4 is an axonometric view of the mat partly opened from the view in FIG. 1 and showing the alternatingly placed hinges.

With reference to FIG. 4, the mat 10 has first section 14, middle section 16 and third section 16, all of like size and shape and of approximately the same dimensions although this is not narrowly critical. Sections 14 and 16 are provided with handles 26, 28 respectively on their inner edges 30, 32. The handle 26 is adjacent the hinge 34 between the first and middle sections 14, 16; the handle 28 is adjacent the hinge 36 between the middle and third sections 16, 18 so that the handles are conveniently disposed when the sections 14, 16 and 18 are folded into face-to-face alignment, See FIG. 1.

Figure 3:
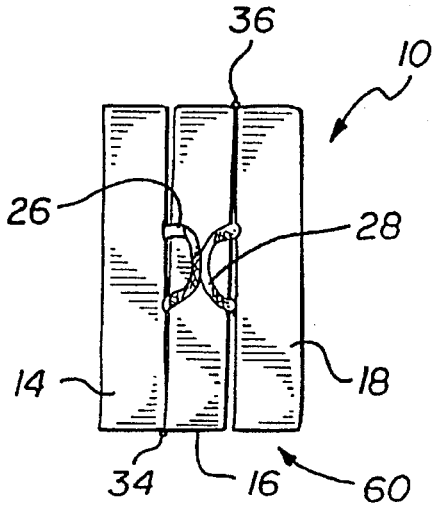
FIG. 3 is a top plan view of the mat.
Figure 2:
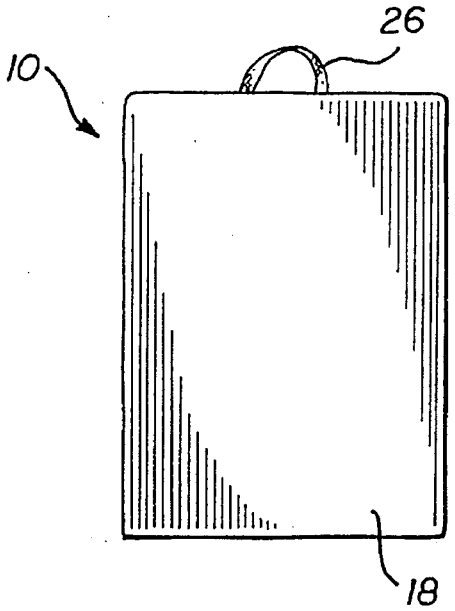
FIG. 2 is a front elevational view of the mat.
Figure 5:
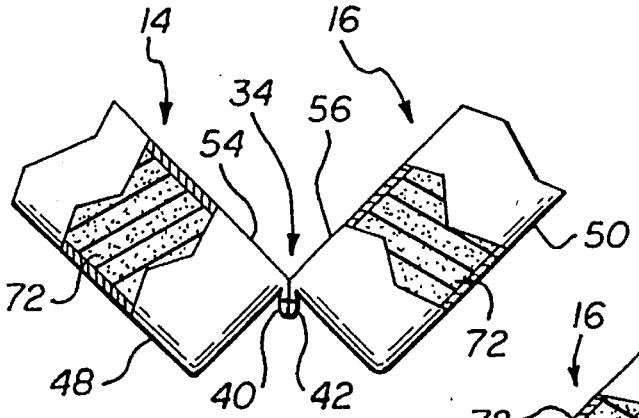
FIG. 5 is a view taken on line 5 in FIG. 4.
Figure 6:
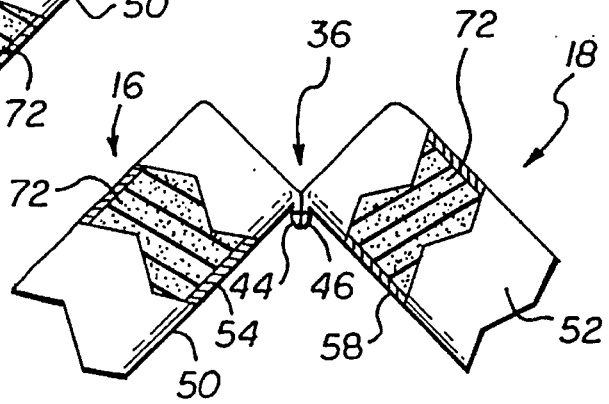
FIG. 6 is a view taken on line 6 in FIG. 4.

The hinges 34, 36 are best shown in FIGS. 5 and 6. Hinges 34, 36 are each formed from continued extents 40, 42 and 44, 46 respectively of the fabric covers 48, 50, 52 on the mat sections 14, 16 and 18 respectively. It will be noted that the hinges 34, 36 being formed from fabric continuations 40–46 project into the space between the sections 14, 16 or 16, 18 are stitched separately from the fabric cover stitching 54. 56, 58 at the adjacent corners of the fabric covers 48, 50 and 52. The fabric cover-free and projecting nature of the hinges 34; 36, in combination with the placement of the hinges alternately high and low, with reference to the longitudinal disposition of the mat, enable achievement of two of the invention salient features: the butted adjacency of the mat sections 14–16 or 16–18 in the longitudinal disposition of the mat 10, forming a continuous surface 24, See FIG. 8, and the compact and flat stacking relation of the mat sections 14–18 without bulging or crowning, See FIGS. 2, 3 and 11.

Figure 7:
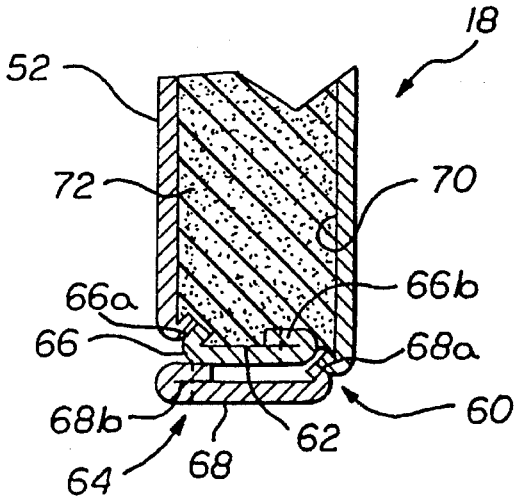
FIG. 7 is a view taken on line 7—7 in FIG. 4.

The fabric covers 48, 50 and 52 are preferably removable. For this purpose, and with reference to FIGS. 4 and 7, as typical of the fabric covers 48–52 for each mat section 14–18, the fabric 60 is doubled at the perimetrical wall 62 of the mat section lateral edge 64 to have an inner skirt 66 and an outer skirt 68, each sewn along its vertical edges 66*a*, 68*a* (the height of the mat section 18) and free at its outer edges 66*b* and 68*b* to form a pocket 70 into which the mat section pad 72 is fitted and from which the pad is removable for replacement or for cleaning of the fabric cover 52.

As will be seen from a consideration of FIGS. 1–11, the mat 10 sections 14–16 being hinged as described will both lie perfectly flat with the sections in edge-to-edge abutting relation, giving a continuous surface 24, or fold upon one another in a perfect rectangle for use as a seat or table or for carting by the handles 26, 28.

The fabric of the covers 48–52 is any suitable durable fabric, such as woven nylon. The pads, e.g. pad 72 are typically foamed plastic such as urethane but may be of any suitable material affording the degree of resiliency desired. Sizes of the mats and pads is not narrowly critical and will be dictated by the customer for which the product is intended. Typically the width of the mat 10 will be about 24 inches, the overall length about 42 inches, the ratio of mat section length, e.g. 14 inches to width, e.g. 24 inches is between about 0.5 and 1. Further, the thickness of the mat pad 72 is typically between 2.5 and 5 inches such that the mat sections when stacked define a low table for a child.

The foregoing object are thus met by the provision of a child's multipurpose mat made of multiple sections and arranged to be opened into a continuously extended mat, folded into a table or seat, or carried conveniently with integral handles. The mat is double hinged by alternately high and low continued extents of the fabric cover joined together to permit free articulation of the mat section without straining the fabric cover and while permitting flat, face-to-face folding of the sections.

I claim:

1. A multipurpose, multisectional mat for a child's use in resting, sitting, lying, reading and like activities comprising first, middle and third sections having like width, length and thickness dimensions, said sections being interconnected to form a mat which when flat will accommodate a recumbent child and when folded will provide a child's seat or table, each section comprising a generally rectangular soft cushion pad of substantial thickness between 2.5 and 5 inches and resilience, and a fabric cover covering the upper, lower and perimetrical portions of each said pad, said cover being locally double layered and partly unfastened along one edge margin opposite the edge of said pad to permit insertion and withdrawal of said pad between said layers, said first section lower portion-covering fabric having a continued extent, said middle section lower portion-coveting fabric having a continued extent opposed and joined to said first section lower portion-covering fabric continued extent and forming a lower hinge therebetween, said third section upper portion-covering fabric having a continued extent, said middle section upper portion-covering fabric having a continued extent opposed and joined to said third section upper portion-covering fabric continued extent and forming an upper hinge therebetween, said upper and lower hinges being diametrically opposed across said middle section, whereby said sections are interconnected in alternately hinged relation to each other to be openable longitudinally in edge-to-edge abutting relation to form a flat mat and foldable flat upon themselves in face-to-face abutting relation to form a chair or table in a stacked horizontal orientation or for portage in a stacked vertical orientation, and handle means projecting from said first and third sections for carrying said mat in its vertical orientation.

2. The multipurpose, multisectional mat for child's use according to claim 1, in which said handle means comprise loops arranged in opposed relation across said middle section in the stacked condition of said sections.

3. The multipurpose, multisectional mat for child's use according to claim 1, in which said handle means are secured to said fabric covering adjacent said hinges.

4. The multipurpose, multisectional mat for child's use according to claims 1, in which the ratio of mat section length to width is between 0.5 and 1.

5. A multipurpose, multisectional mat for a child's use in resting, sitting, lying, reading and like activities comprising first, middle and third sections like to each other in length, width and thickness and interconnected to form a mat which when flat will accommodate a recumbent child on abutted sections and when folded will provide a child's seat or table, each section comprising a generally rectangular soft cushion pad of substantial thickness between 2.5 and 5 inches and resilience, a fabric cover covering the upper, lower and perimetrical portions of said pad, said sections being articulated to one another by local portions of said fabric cover joined between said pads in hinge-forming relation for the sections to alternately lie in edge-to-edge abutting relation when the mat is elongated and in face-to-face abutting relation when the mat sections are stacked, said fabric cover being locally unfastened along one edge for insertion or withdrawal of the pad within said fabric cover, and handles projecting from said first and third sections for carrying said mat in its vertical orientation, said cover being locally double layered and partly unfastened along one edge margin opposite the edge of said section to permit insertion and withdrawal of said pad between said layers.

* * * * *